US005494469A

United States Patent [19]

Heath et al.

[11] Patent Number: 5,494,469

[45] Date of Patent: Feb. 27, 1996

[54] INFLATABLE LIFE VEST

[75] Inventors: Cleveland A. Heath, Medfield; Maurice W. Roy, Natick, both of Mass.

[73] Assignee: The United States of America as represented by the Secretary of the Navy, Washington, D.C.

[21] Appl. No.: 316,709

[22] Filed: Sep. 30, 1994

[51] Int. Cl.[6] ..... B63C 9/08

[52] U.S. Cl. ..... 441/118

[58] Field of Search ..... 441/80, 91, 92, 441/96, 108, 118, 88

[56] References Cited

U.S. PATENT DOCUMENTS

| | | | |
|---|---|---|---|
| 836,524 | 11/1906 | Morrell | 441/91 |
| 1,288,857 | 12/1918 | Farr | 441/108 |
| 1,663,268 | 3/1928 | Foley et al. | 441/91 |
| 1,917,613 | 7/1933 | Szumkowski | 441/91 |
| 3,046,576 | 7/1962 | Bernhardt | 441/92 |
| 3,117,326 | 1/1964 | Bernhardt et al. | 441/118 |
| 3,791,982 | 10/1973 | Hawkins | 441/118 |
| 3,895,396 | 7/1975 | Amarantos | 441/96 |
| 4,181,993 | 1/1980 | McDaniel | 441/108 |
| 4,850,912 | 7/1989 | Koyanagi | 441/80 |

*Primary Examiner*—Stephen Avila
*Attorney, Agent, or Firm*—Michael J. McGowan; Prithvi C. Lall; Michael F. Oglo

[57] ABSTRACT

An inflatable life vest comprises two sheets of polymeric material. The edges of these sheets are sealed to form an inner cavity with a plurality of discrete, inflatable chambers disposed in a U-shaped pattern to define collar and chest portions of the life vest. A manifold connects to an inflation source and has a plurality of openings. A check valve connects each manifold opening with one of the chambers to permit inflation medium flow into the chamber and to block inflation medium flow outwardly from a chamber into the manifold. This construction isolates the chambers from one another so the rupture of one chamber does not affect the ability of the other chambers to be buoyant.

13 Claims, 2 Drawing Sheets

INFLATABLE LIFE VEST

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to aquatic flotation devices and more particularly to inflatable flotation vests.

(2) Description of the Prior Art

Two popular types of inflatable life vests generally comprise either a single continuous inflatable chamber or two back-to-back chambers. There are certain disadvantages associated with such life vests particularly when such a vest is punctured. Specially, puncturing a single chamber vest completely destroys the usefulness of the vest as a flotation device. While the dual chamber life vests avoid complete deflation by providing redundant chambers, such life vests are generally stored and also worn, as a precautionary or safety device, with the deflated chambers adjacent one another. It is likely that any puncture will involve both chambers. Dual-chamber inflatable life vests tend to be heavier and more expensive than vests with single chambers because the two-chamber vests require an inflation mechanism for each chamber. This duplication increases the cost and the weight of such life vests.

U.S. Pat. No. 3,046,576 to Bernhardt discloses a third type of life jacket that is essentially a hybrid of the first and second types. A first chamber forms a collar that forms a collar substantially encircling the user's neck. A second section overlies a portion of the user's chest. Each chamber attaches to a supporting member and connects through check valves and a common conduit to a compressed air source for selective inflation. By design the inflation path for the first chamber has less resistance than the inflation path for the second chamber. Consequently the first, or collar, chamber inflates first. If the second chamber does not inflate during this procedure, a hose with check valve and mouth piece connected to the second chamber enables direct inflation of the second chamber. However, it is not possible to inflate the first chamber through this hose.

Some other types of flotation vests have a spaced array of mutually isolated air chambers as disclosed in U.S. Pat. No. 836,524 to Morrell and U.S. Pat. No. 4,181,993 to McDaniel. The Morrell patent discloses a lifesaving suit having a rubber shirt and pants worn by the user. A series of isolated air compartments allow the vest to remain buoyant even if one compartment is punctured. The compartments on each side of the suit are filled by hand operated pumps positioned on respective sides of the suit.

The McDaniel patent discloses a flotation garment with first and second sheets of a thermoplastic film bonded face to face along a rectilinear grid work of seams forming a spaced array of mutually isolated air cells. The garment will not substantially lose its buoyancy when a portion of the cells are punctured. The bonded seams are perforated at selected points to enable adequate ventilation.

Other known types of inflatable devices including swimming floats, boat and buoy floats, and other protection devices are described in the following U.S. Pat. Nos.

1,917,613 (1933) Szumkowski 3,895,396 (1975) Amarantos 4,850,912 (1989) Koyanagi In the Szumkowski patent, for example, a swimming float comprises an air duct worn on the user's waist for interconnecting a series of air chambers formed by bicycle inner tubes that are closed at one end. A hand pump provides a source of inflation fluid. Some air chambers secure at their closed ends to the swimmer's legs and others secure to the upper back and chest to provide buoyancy. Hand operated valves in the air duct isolate series of the chambers against deflation in case of a rupture of others.

The Amarantos patent discloses a deployable protection device having plurality of attached, elongated inflatable cells worn in a rolled up condition about the waist which are selectively inflated. The cells unroll upon inflation to extend upwardly and downwardly about the wearer to protect the user from an environmental change, and the cells interconnect with the inflation source through a check valve to inhibit deflation of the cells thereby.

The Koyanagi patent discloses sealed containers for containing a fluid and for such uses as lifesaving buoys and boat flotation members. Specifically, a plurality of sac-like containers connect through individual check valves to a guide tube for inflating and resisting deflation of the containers through the guide tube.

Each of these references fail to disclose, singularly and collectively, a inflatable life vest having a plurality of inflatable chambers arranged about the wearer so as to support the wearer in the event of a puncture of one or more of the chambers. The references also fail to teach a life vest having a plurality of chambers which is relatively easy to use, to store and manufacture.

SUMMARY OF THE INVENTION

It is an object of the present invention to provide an improved inflatable life vest having a plurality of isolated chambers.

It is another object of the present invention to provide a life vest with a plurality of isolated chambers to enable inflation of some of the chambers and to inhibit deflation of others in the event of a puncture of one of the chambers.

It is a further object of the present invention to provide an improved inflatable life vest providing continued buoyancy to the user in the event of pre-inflation and post-inflation punctures.

It is still another object of the present invention to provide an improved life vest which comprises a plurality of chambers inflatable from a single oral or mechanical source for inflating unpunctured chambers and keeping such chambers inflated in the event of puncture of any other chamber.

It is still a further object of the present invention to provide an improved inflatable life vest that is relatively light, easily stored and inexpensive and that can be inflated from a single inflation source and that comprises a plurality of discrete, isolated inflation chambers.

According to one aspect of the present invention an inflatable life vest comprises a plurality of discrete, walled, inflatable chambers disposed in a U-shaped, abutting pattern to define a life vest. A manifold intermediate an inflation source and each of the chambers connects the source with the chambers. Check valves connect the manifold to each of the chambers so as to inhibit flow of the inflation medium from each of the chambers into the manifold whereby the rupture of one chamber does not cause others of the chambers to deflate.

According to another aspect of the present invention a life vest comprises overlying, gas impervious sheets of material sealed along their edges to form a U-shaped structure defining a collar and chest portion of a life vest with corresponding isolated chambers. Internal dividers divide individual chambers into cells. Check valves disposed in the dividers introduce an inflation fluid from a manifold into each of the cells and inhibit any outflow from an inflated chamber or cell into the manifold.

According to a further aspect of the present invention an improved inflatable life vest comprises a first inflatable chamber having a C-shaped configuration defining a collar portion of the life vest for surrounding the neck of a person and a second and third inflatable chambers defining a first side and a second side, respectively, of the lower portion of the life vest. Walls of the second and third chambers abut the first and second ends, respectively, of the first chamber. A manifold formed in the life vest connects to each chamber through a check valve so an inflation medium can flow into each of the chambers and can not flow from any of the inflated chambers into the manifold.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
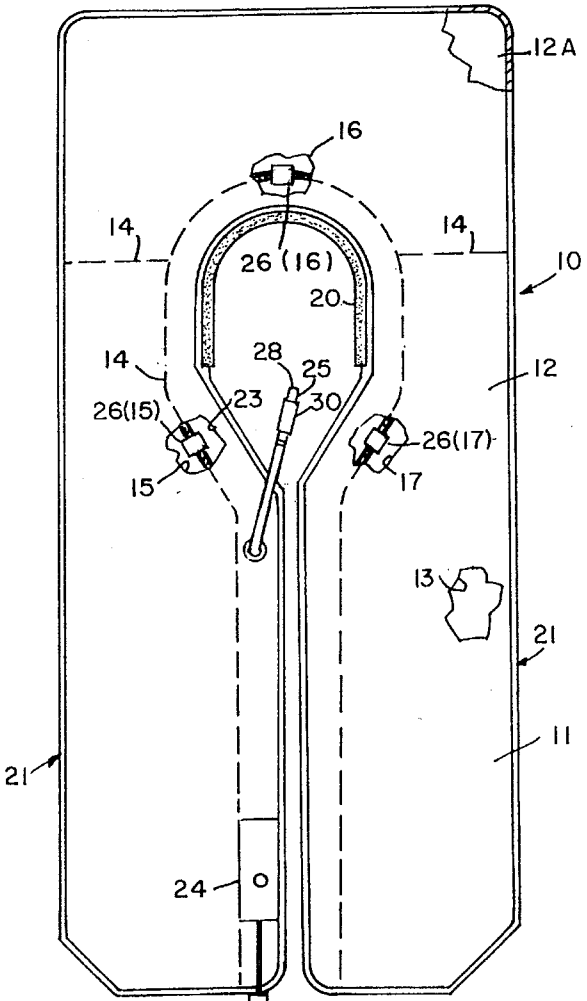
FIG. 1 is a top plan view of a life vest constructed in accordance with the present invention.

FIG. 1 depicts a life vest constructed in accordance with the present invention. The life vest 10 comprises an outer shell 11 formed of two overlying sheets 12 and 12A (only a portion of sheet 12A appears in FIGS. 1 and 2). Each of the sheets 12 and 12A can be formed from a suitable gas-impervious material, such as polyurethane coated nylon. Sealing the edges of the sheets 12 and 12A, preferably by fusing the sheets along the edges, defines an inflation medium retaining cavity 13 within the shell 11. It will be understood that inner walls or dividers 14 divide the cavity 13 into a plurality of discrete, walled, pneumatically isolated, inflatable chambers 15, 16, and 17. The sheets 12 and 12A and the chambers 15, 16 and 17 form a U-shaped life vest 10 with a collar portion 20 and chest portions 21 . Moreover each chambers 15, 16 and 17 are arranged seriatim about a U-shaped axis so that each chamber abuts at least one other chamber. For example, opposite ends of the chamber 16 abut chambers 15 and 17 respectively.

A manifold 23 interconnects an inflation source, such as a manually operable compressed gas cylinder 24 or oral inflation tube 25, and each of chambers 15, 16, and 17. An inflation medium such as carbon dioxide or air, can be directed from a common point through the manifold to each of the chambers 15, 16 and 17. In accordance with this invention, conventional one-way gas check valves 26 define ports between each of the chambers and the manifold 23. More specifically, check valves 26(15), 26(16) and 26(17) enable the inflation medium to flow from the manifold 23 into respective ones of the chambers 15, 16 and 17 in a downstream direction when the pressure in the manifold 23 is greater than the pressure in the chambers 15, 16 and 17.

Stated differently, the inflation medium flows into the chambers under a "positive" pressure gradient. Conversely, if a "negative" pressure gradient exists (i.e., the pressure in a chamber exceeds the pressure in the manifold 23), the check valves 26 block any upstream flow into the manifold 23 so the chambers 15, 16 and 17 remain inflated. Thus, if one inflated chamber, such as chamber 16, were to deflate for any reason, a negative pressure gradient would exist between the other chambers, such as chambers 15 and 17. Consequently, the chambers 15 and 17 would remain inflated because the check valves essentially isolate each chamber from the other chambers even through all the chambers are filled from a common manifold 23.

To use the present invention, a user dons a deflated vest 10 by pulling it over his or her head and affixing the chest portions 21 in place at the user's upper, anterior thorax by means of an integral strap or other known device (not shown) around the legs or waist. The vest 10 can also be inserted in a garment such as, a survival vest worn by flight deck personnel in the United States Navy to thereby secure the vest 10 on the user. The user can then inflate the life vest 10 by activating the compressed gas container 24, as by pulling on the release cord 27, or by blowing air through a mouth piece 28 and a check valve 30 of the oral tube 25. In either method, the inflation medium pressurizes the manifold 23. The resulting positive pressure gradient forces the inflation medium through the check valves 26 to inflate the chambers 15, 16 and 17 until the pressures in the manifold 23 and the chambers 15, 16 and 17 reach an equilibrium value or the pressure in the manifold 23 falls below the pressure in the essentially parallel chambers 15, 16 and 17.

As will now be apparent, the accidental puncture of one chamber or the manifold does not deflate all the chambers. For example, if a puncture of the life vest 10 in FIG. 1 deflates only chamber 15, chambers 16 and 17 remain fully inflated. Assuming the life vest 10 has chambers of approximately equal volume, the life vest 10 retains about two-thirds of its original buoyancy. If a puncture were to involve chambers 15 and 16, the life vest 10 would retain about one-third of its original buoyancy. Even such minimal buoyancy is helpful because, as known, the average density of a human is approximately equal to the density of water.

Figure 2:
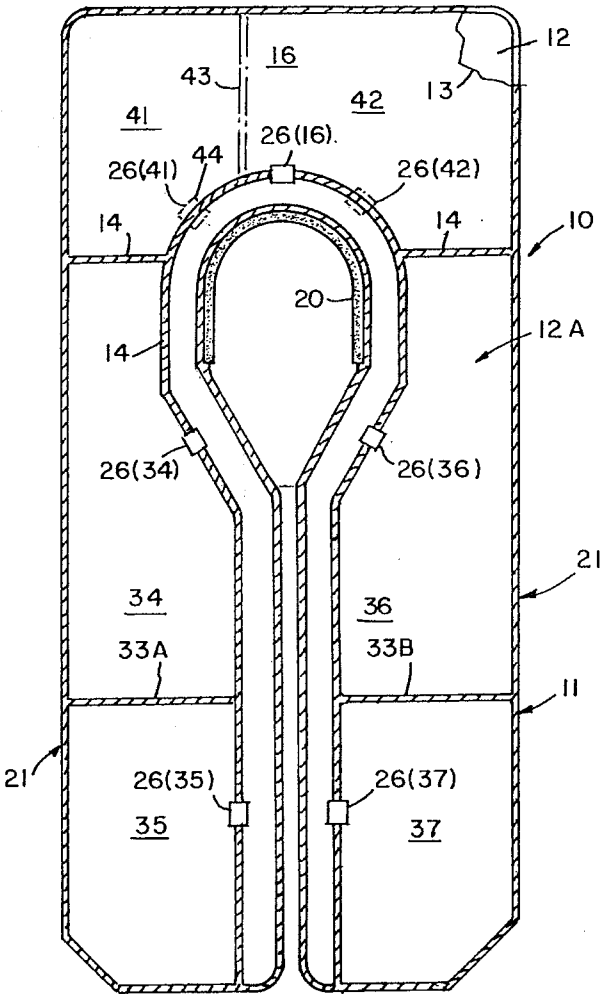
FIG. 2 is a top plan view with a portion broken away of another embodiment of a life vest of the present invention.

In the alternative embodiment of FIG. 2, additional inner walls 33 divide the life vest 10 into five isolated chambers, rather than the three isolated chambers of FIG. 1. Specifically, one wall 33A defines chambers 34 and 35 in place of the chamber 15; another wall 33B, chambers 36 and 37 in place of the chamber 17. Each of the chambers 34 and 36 connects through check valves 26(34) and 26(36) while each of the chambers 35 and 37 connects through check valves 26(35) and 26(37). All the inputs to the check valves 26 communicate with the manifold 23 in substantially the same way as described with respect to the embodiment of FIG. 1.

It also will be understood that the chamber 16 can be additionally divided into isolated chambers 41 and 42 using a wall 43 and check valves 26(41) and 26(42) shown in phantom in FIG. 2. The exact number of independent chambers in a life vest constructed in accordance with this invention will be a compromise between the acceptable loss of buoyancy if a chamber deflates and the costs of producing a life vest with additional chambers. For example, assuming essentially equal volumes for each of the five chambers in FIG. 2, the life vest 10 retains about 80% of its original buoyancy if one chamber is punctured. Doubling the number of isolated chambers increases that buoyancy to about 90% of the original buoyancy, but adds the costs of five additional chambers and check valves to the cost of the life vest.

Figure 3:
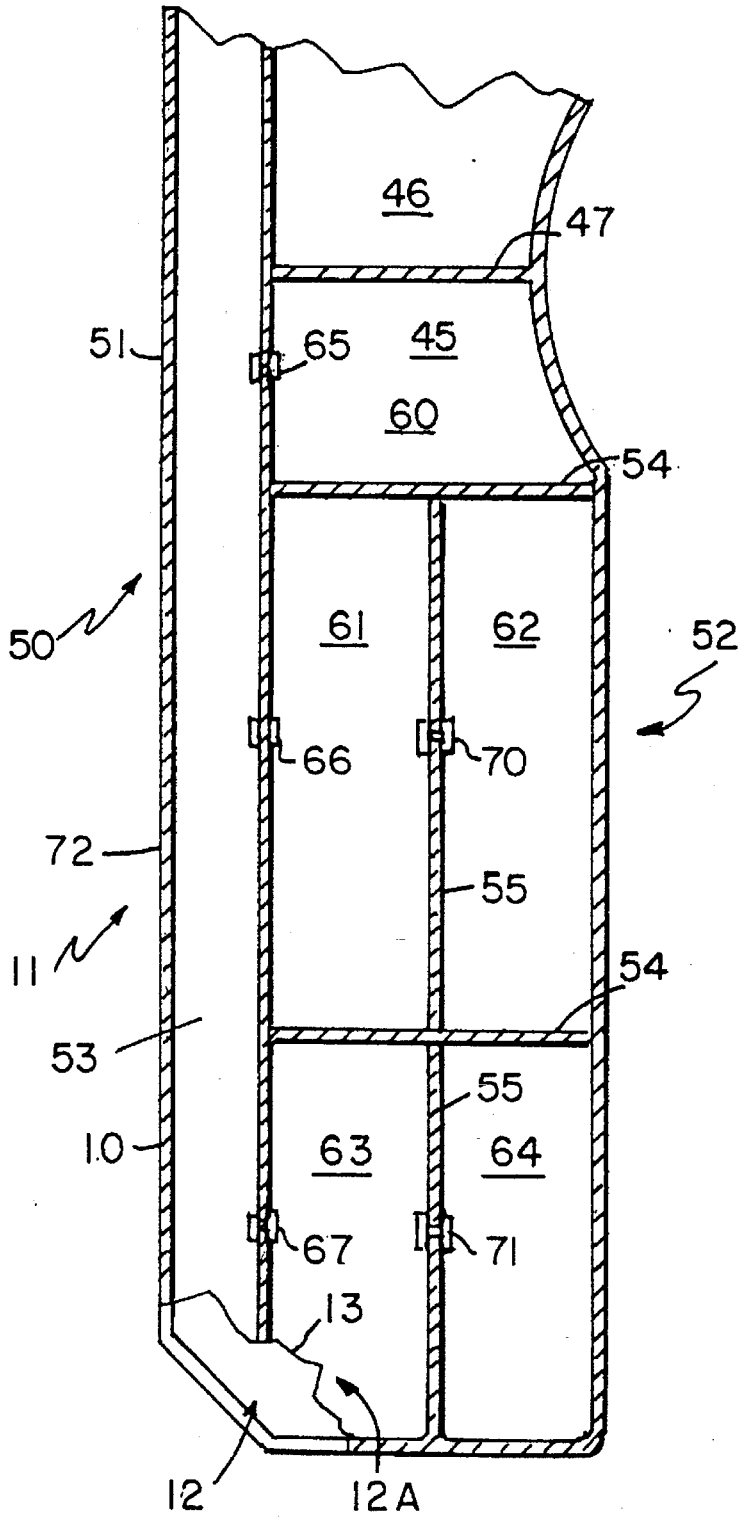
FIG. 3 is a top plan view of a portion of an alternative embodiment of a life vest according to the present invention.

FIG. 3 depicts a portion of an alternative form of a life vest 50 that includes a chamber 45. A chamber 46 abuts the chamber 45 at a wall 47. The vest 50 has a front portion 51 and a rear portion 52. The front portion 51 of the vest 50 carries a manifold 53. The rear portion 52 lies against a user's torso when the vest 50 is properly donned. The chambers 45 and 46 and the manifold 53 are analogous to the chambers 15 and 16 and manifold 23 in FIGS. 1 and 2, although the internal dividing walls are rearranged. In this alternate embodiment, internal walls 54 and 55 divide another chamber into a plurality of isolated cells 60 through 64. Cells 61 and 62 are located at the front portion 51 of the vest 50 and connect directly with the manifold 53 through check valves 65, 66, and 67. Cells 62 and 64 are located behind and connect to the cells 61 and 63 through check valves 70 and 71 respectively.

In the embodiment of FIG. 3, the manifold 53 extends along an outer edge 72 at the front portion 51. Those skilled in the art will appreciate that the manifold 53 need not be formed integrally with the life vest 50 although such a construction is preferred.

Although the embodiment of FIG. 3 provides additional cells within an isolated chamber, not all of the cells are isolated. For example, a puncture of one of the cells 62 and 64 deflates that cell and a corresponding one of the cells 61 and 63. Also, if one of the cells 61 and 63 were punctured, it would not be possible to inflate a corresponding one of the cells 62 and 64. Nevertheless, this embodiment does increase the number of possible isolated cells and may be useful in many circumstances.

It will now be appreciated that a life vest with a plurality of isolated chambers and cells in accordance with this invention improves the reliability of the life vest. The rupture of any one chamber or cell leaves a greater portion of the chambers and cells inflated thereby retaining a greater percentage of the total life vest design buoyancy. If a chamber or cell ruptures during storage and prior to inflation, the user can pinch off the affected fluid path proximate a corresponding check valve to enable inflation of the other chambers and cells. Those skilled in the art will now understand that the positioning of the inner walls or dividers defining the chamber and individual cells with a chamber, if any, as well as the manifold, as depicted in the foregoing embodiments are merely illustrative and may be rearranged without departing from the scope of the present invention.

In recapitulation, an inflatable life vest in accordance with the present invention comprises a plurality of discrete walled, inflatable chambers disposed in a U-shaped pattern to define a collar and chest portions of the life vest. A manifold connects to an inflation source and has a plurality of openings for distributing an inflation medium. A check valve couples each opening in the manifold to a corresponding chamber to enable the inflation medium to flow into the chamber, but to inhibit the inflation medium from flowing outwardly, i.e., from the chambers into the manifold.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. An inflatable life vest for being inflated by an inflation medium from an inflation source comprising:

a given plurality of discrete, inflatable chambers in seriatim along an U-shaped axis to define thereby a collar and chest portions of the life vest, each of said chambers abutting at least another of said chambers;

a manifold having a first opening for connecting the inflation source and a plurality of second openings corresponding to the given plurality;

a chamber check valve connecting each said second opening and one of said chambers to inhibit flow of the inflation medium from a said chamber into said manifold whereby a said chamber remains inflated upon rupture of another of said chambers.

2. An inflatable life vest as recited in claim 1 wherein at least one of said chambers includes walls that divide said chamber into a plurality of contiguous inflatable cells including a first cell at said chamber check valve and cell check valves for coupling adjacent cells within said chamber.

3. An inflatable life vest as recited in claim 1 further comprising inflation means carried by the life vest connected to said first opening in said manifold for enabling a user to inflate the life vest.

4. An inflatable life vest as recited in claim 3 wherein said inflation means includes a selectively actuated compressed gas container connected to said first opening of said manifold.

5. An inflatable life vest as recited in claim 3 wherein said inflation means includes a mouth piece, a breathing tube connecting said mouth piece with said first opening of said manifold, and a check valve disposed in said breathing tube enabling a user thereof to inflate the chambers by breathing into said mouth piece and inhibiting outflow from said manifold.

6. A life vest comprising:

overlying sheets of gas impervious material sealed along their edges to form an integral U-shaped structure defining a collar and chest portion with an internal cavity;

internal gas impermeable dividers in said cavity for forming with said sheets a plurality of discrete, pneumatically isolated, inflatable chambers;

a manifold having a first opening and a plurality of second openings; and a chamber check valve connecting one of said second manifold openings to one of said chambers for introducing an inflation medium into each of said chambers from said manifold and for inhibiting outflow of the inflation medium from each of said chambers into said manifold.

7. A life vest as recited in claim 6 wherein said manifold is integrally formed within said cavity and extends along a divider defining each of said chambers.

8. A life vest as recited in claim 7 wherein said sheets are composed of a polyurethane coated nylon.

9. A life vest as recited in claim 7 wherein at least one of said chambers includes gas impervious walls formed therein to define individual cells with one of said cells communicating with a chamber check valve and a cell check valve for enabling flow from said one cell to any adjacent cell in said chamber.

10. An improved inflatable life vest comprising:

first inflatable chamber having a C-shaped configuration defining a collar portion of the life vest for supporting the head of a user of the life vest upon inflation thereof;

second and third inflatable chambers defining first and second sides, respectively, of a lower portion of the life vest for supporting the upper, anterior thorax of the user upon inflation thereof, each of said second and third chambers having a wall abutting a first and a second end, respectively, of said C-shaped first chamber;

a manifold in the life vest coextensive with portions of said first, second and third chambers, and first, second, and third check valves positioned in said manifold connecting to said first, second and third chambers, respectively, for enabling a flow of an inflation medium in a downstream direction from said manifold into a corresponding one of said chambers and for inhibiting flow from any of said chambers into said manifold whereby inflated ones of said chambers remain inflated upon rupture of any other of said chambers.

11. An improved life vest as recited in claim 10 wherein said manifold extends exteriorly of said chambers and said first, second and third check valves are disposed in a common wall of said inflation path and said first, second and third chambers, respectively.

12. An improved life vest as recited in claim 11 wherein one of said chambers includes internal dividing walls therein defining a plurality of isolated cells in said chamber and a plurality of check valves interconnecting individual ones of said cells.

13. An improved life vest as recited in claim 10 further comprising inflation means carried by the life vest connecting with said manifold for introducing the inflation medium into said manifold to thereby inflate said chambers.

* * * * *